US006953206B1

(12) United States Patent
Dilz et al.

(10) Patent No.: US 6,953,206 B1
(45) Date of Patent: Oct. 11, 2005

(54) SAFETY ADHESIVE FOIL AS IDENTIFICATION ELEMENT

(75) Inventors: Bernhardt Dilz, Sindelfingen (DE); Arne Koops, Hamburg (DE); Petra Lawrence, Aidlingen (DE)

(73) Assignees: DaimlerChrysler AG, Stuttgart (DE); tesa AG, Hamburg (DE)

( * ) Notice: Subject to any disclaimer, the term of this patent is extended or adjusted under 35 U.S.C. 154(b) by 0 days.

(21) Appl. No.: 09/914,790

(22) PCT Filed: Jan. 29, 2000

(86) PCT No.: PCT/EP00/00724

§ 371 (c)(1),
(2), (4) Date: Dec. 19, 2001

(87) PCT Pub. No.: WO00/54243

PCT Pub. Date: Sep. 14, 2000

(30) Foreign Application Priority Data

Mar. 5, 1999 (DE) ..... 199 09 723

(51) Int. Cl.[7] ..... G09F 3/00

(52) U.S. Cl. ..... 283/72; 283/81; 283/85; 283/101; 283/117; 283/901; 428/40.1; 428/40.2; 428/41.7; 428/343; 428/916; 40/299

(58) Field of Search ..... 428/40.1, 343, 428/916, 40.2, 41.7; 283/72, 81, 101, 901, 283/85, 117; 40/299

(56) References Cited

U.S. PATENT DOCUMENTS

| | | | | |
|---|---|---|---|---|
| 4,841,652 | A * | 6/1989 | Sakashita et al. | 283/81 |
| 4,987,287 | A * | 1/1991 | Jack | 219/121.69 |
| 5,060,981 | A * | 10/1991 | Fossum et al. | 283/109 |
| 5,151,572 | A * | 9/1992 | Jack | 219/121.69 |
| 5,364,132 | A * | 11/1994 | Haas et al. | 283/67 |
| 5,582,887 | A * | 12/1996 | Etheredge | 428/41.5 |
| 5,843,547 | A * | 12/1998 | Kulper et al. | 428/40.1 |
| 5,885,677 | A * | 3/1999 | Gosselin et al. | 428/40.1 |
| 6,165,609 | A * | 12/2000 | Curatolo | 428/343 |
| 6,444,068 | B1 * | 9/2002 | Koops et al. | 156/99 |
| 2002/0105183 | A1 * | 8/2002 | Holt et al. | 283/81 |
| 2003/0031861 | A1 * | 2/2003 | Reiter et al. | 428/343 |
| 2003/0104309 | A1 * | 6/2003 | Koops et al. | 430/201 |
| 2004/0026921 | A1 * | 2/2004 | Krone et al. | 283/92 |

FOREIGN PATENT DOCUMENTS

| | | | |
|---|---|---|---|
| DE | 3813303 C1 * | 7/1989 | |
| DE | 4231800 A1 * | 3/1994 | G09F 3/00 |

* cited by examiner

*Primary Examiner*—Derris H. Banks
*Assistant Examiner*—Mark Henderson
(74) *Attorney, Agent, or Firm*—Crowell & Moring LLP

(57) ABSTRACT

The invention relates to an inscribable security film, in particular for use in the automotive sector, and to a method for inscribing it. The security film contains an identification medium which is capable of diffusion and is locally liberated or fixed selectively by means of a contactless inscription process. If the security film is adhesively bonded to a substrate, the identification medium causes permanent marking of the substrate, which ensures unambiguous identification of the object in question.

22 Claims, 2 Drawing Sheets

SAFETY ADHESIVE FOIL AS IDENTIFICATION ELEMENT

Figure 1A:
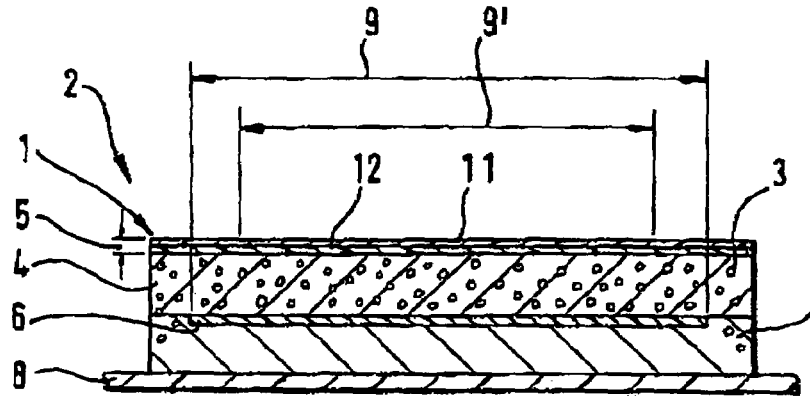

The invention relates to an inscribable adhesive security film which contains an identification medium which is capable of diffusion. If the film is adhesively bonded to a substrate, the identification medium causes permanent marking of the substrate.

Security films and security labels play a major role in the marking of workpieces and documents which are at risk of theft or a relevant to security. They are adhesively bonded to the object which is to be secured and can only be copied and/or removed from the object surface, namely the substrate, with considerable difficulty. Security films and labels whose inscription remains permanently detectable on the underlying substrate even after the film or label has been removed are particularly advantageous: they force the thief or forger to carry out complex further work in order to remove the traces of the inscription on the substrate and/or to produce a forged inscription of the substrate. As a result, they considerably reduce the attractiveness of theft or forgery. To achieve permanent inscription of the substrate, the security film is provided with an identification medium which is capable of diffusion, migrates into the underlying substrate after the film has been stuck on, and causes a physical and/or chemical reaction in the substrate.

U.S. Pat. No. 5,346,738 has disclosed a security label which contains an acid in micro-encapsulated form as identification medium. If a pressure is exerted on the label—in particular as a result of the operation of bonding to an object—the encapsulation breaks open, the identification medium is released and diffuses to the substrate surface, on which it causes an etching reaction. The inscription operation is in this case an integral part of the chemical/industrial manufacturing process of the label and therefore has to take place at the premises of the label manufacturer. Therefore, these labels are unable to satisfy an imperative requirement of the user if effective protection against theft is to be achieved, namely that the inscription of the labels can be carried out on the user's own premises and with minimum possible notice, and that the inscription pattern can be changed as required, in order to be able to ensure the highest possible security against forgery.

A further drawback of these labels consists in the fact that the inscription of the upper side of the label takes place in a further, separate process step, making the process complex and susceptible to faults.

The generic WO 97/40484 has disclosed a security label which contains an adhesive layer with an identification medium which is capable of diffusion. The label is inscribed through a barrier medium which, in a manner corresponding to the inscription, is selectively applied to the adhesive layer in such a way that it partially masks the side which faces the substrate. When the label is adhesively bonded to the substrate, the barrier medium is intended to locally prevent or reduce the diffusion of the identification medium from the adhesive layer to the substrate, while unimpeded diffusion is supposed to take place in the areas which are free of barrier medium. Although the inscription of the labels, i.e. the application of the barrier medium, can be carried out by the user at his own premises, this is a process which is susceptible to faults, since it is necessary to ensure that the durability and adhesive properties of the label are not impaired by the inscription. Consequently, these security labels have only a restricted suitability for use in the factory environment.

The invention is therefore based on an object of providing a durable security film which can be inscribed quickly and easily in the factory environment and, at the same time, makes it more difficult to falsify the identity of the products which are to be secured in the event of theft.

According to the invention, the object is achieved by the features of claim 1.

According to this claim, the security film contains a carrier layer which includes an identification medium. The diffusion properties of this identification medium can be selectively and locally varied in a controlled manner with the aid of a contactless inscription process. If the security film which has been inscribed in this way is adhesively bonded to a workpiece, the identification medium diffuses towards the substrate surface, where it brings about a detectable reaction. This diffusion or reaction takes place only in those areas of the substrate surface in which the diffusion capability has been initiated or not impeded by the inscription operation. Consequently, the security film allows unambiguous inscription and identification of the workpiece.

According to the invention, the security film is inscribed by means of a contactless method. Consequently, an inscription which is insensitive to dirt, is quick and can be varied flexibly can be achieved even in the factory environment. The inscription of the security film—and therefore the change in the diffusion properties of the identification medium—can be carried out in particular with the aid of electromagnetic radiation (cf. Patent claims 2 and 3). To inscribe the security film, it is particularly advantageous to use a laser, which can be used to carry out both temperature-sensitive and light-sensitive inscription (in this context, the term "light" includes the entire region of the electromagnetic spectrum which is accessible to the laser). Lasers have the additional advantage of allowing high-contrast inscriptions with any desired choice of pattern, enabling rapid changes to the inscription pattern and of being capable of being used reliably in a factory process (cf. Patent claim 4).

The identification medium selected is a substance which triggers a detectable reaction on the substrate (cf. Patent claim 5). For this purpose, the identification medium must be matched to the material properties of the substrate. For example, the identification medium may contain a dye—which is matched to the substrate—which locally diffuses into the substrate surface and dyes the latter. Alternatively, the identification medium may contain a substance which enters into a chemical reaction with the substrate surface. Reactions in which the substrate surface is locally removed or locally expanded, so that the inscription of the substrate, after removal of the film, can be detected visually or alternatively by touch, are of particular interest in this context. To mark metallic substrates, an identification medium which contains an etching substance is particularly recommended (cf. Patent claim 6).

To increase the protection against theft, it may be advisable to chose an identification medium whose influence on the underlying substrate cannot be detected by the naked eye. This can be achieved with an identification medium which influences the absorption and reflection properties of the substrate in, for example, only the UV or IR region, but not in the visible region (cf. Patent claim 5). If a thief or forger removes the film, the substrate does not contain any visible traces of the marking, and the thief or forger will see no need to remove or cover over the substrate surface in the areas affected. The areas affected in this case continue to include the marking, which can easily be detected by informed security services with the aid, for example, of a UV or IR viewing device. In particular, the identification medium may be selected in such a way that the detectability, e.g. the UV fluorescence, takes place only at certain wavelengths of the testing light.

For industrial use of the security film, in particular in the automotive industry, the film must be highly robust with regard to the influences of temperature and light. These requirements can be fulfilled most successfully if the security film has physical barriers which prevent the diffusion of the identification medium in the uninscribed state of the film (cf. Patent claim 7). During the inscription operation, these barriers are locally destroyed or weakened, so that selective diffusion of the identification medium can take place in the areas which have been weakened in this way. To make the inscription highly resistant to temperature or light, the temperatures or light intensities which are required to destroy the barriers must be significantly higher than those to which the object to be marked is subjected during use, even under extreme environmental conditions.

This prevention of the diffusion of the identification medium, which can be eliminated by contactless inscription, can advantageously be achieved by micro-encapsulation of the identification medium in the carrier layer. The identification medium is enclosed in capsules, the walls of which consist, for example, of wax and/or fat and can be broken open by, for example, the local influence of heat in the relevant areas of the film, so that the identification medium contained therein can escape and—on coming into contact with the substrate—diffuse into the latter or react with the latter (cf. Patent claim 8).

A particularly high temperature stability of the inscription can be achieved if the barrier is formed by a barrier layer which is arranged in sheet form between the carrier layer and an adhesive layer and which, in the uninscribed state of the film, prevents the diffusion of the identification medium out of the carrier layer (cf. Patent claim 9). Inscription of the film locally breaks through the barrier layer, so that the identification medium can locally escape from the carrier layer at these locations and can diffuse into the adhesive layer. If the film is adhesively bonded to a substrate by the adhesive layer, selected areas of the substrate surface come into contact with the diffused identification medium and undergo a chemical or physical reaction. Those areas of the barrier layer which remain undamaged during the inscription effectively prevent diffusion of the identification medium and therefore a reaction in these uninscribed areas. Both the inscription method and the position of the barrier layer inside the security film form effective protection for the film against imitation and forgery. Furthermore, it is possible to select an identification medium which is in diffusable form in the uninscribed security film but is locally fixed during the inscription (cf. Patent claim 10).

On the one hand, it is possible for the carrier layer to form a type of matrix in which the identification medium is embedded. Alternatively, the material of the carrier layer itself may form the identification medium, so that the carrier layer consists of identification medium (cf. Patent claim 11).

For rapid identification of the security film, it may be expedient if the inscription of the security film which is impressed on the carrier layer or the barrier layer is shown visibly not only on the substrate but also on the film itself. For this purpose, it is particularly advantageous to provide the film with a covering layer, which is inscribed together with the inscription of the identification medium in the same process step (cf. Patent claim 12). For this purpose, the use of a multi-layer laser-inscribable covering layer has proven particularly expedient.

To protect the security film or the security labels produced therefrom, and also with a view to ease of handling, they are expediently arranged on a release paper (cf. Patent claim 13). This allows considerable simplification of transport, separation and inscription of the film or the labels.

To characterize an object having a security label which has been produced from the security film, the uninscribed label is first of all adhesively bonded to the object surface; there then follows the contactless inscription, as a result of which the identification medium is liberated and the permanent marking of the object surface is initiated (cf. Patent claim 14). This inscription sequence has the advantage that the inscription takes place directly on the object which is to be protected, and it is therefore possible to rule out incorrect marking of the object as a result of labels being swapped over. On the other hand, the inscription process selected—for example the heat development produced by the inscription laser—may cause undesirable damage, in particular to sensitive object surfaces. In this case, the security label is expediently initially inscribed separately, so that the identification medium is locally liberated, and then the label which has been inscribed in this way is adhesively bonded to the object (cf. Patent claim 15).

The security film according to the invention is particularly suitable for marking motor vehicles (cf. Patent claim 16) which are at great risk of theft. The marking allows unambiguous identification of the vehicle at any time. It is also recommended for expensive components and devices of the vehicle, which are at particular risk of theft, to be marked separately in order to be able to detect their identity independently of the vehicle. To mark the vehicle body, it is expedient to use an identification medium which undergoes a reaction which is detectable—although under certain circumstances not visible to the naked eye—with the vehicle paint (cf. Patent claim 17).

In the text which follows, the invention is explained in more detail with reference to a number of exemplary embodiments which are illustrated in the drawings and in which:

FIG. 1 shows a sectional view of a security label which has been produced from security film and has a barrier layer . . .

Figure 1B:
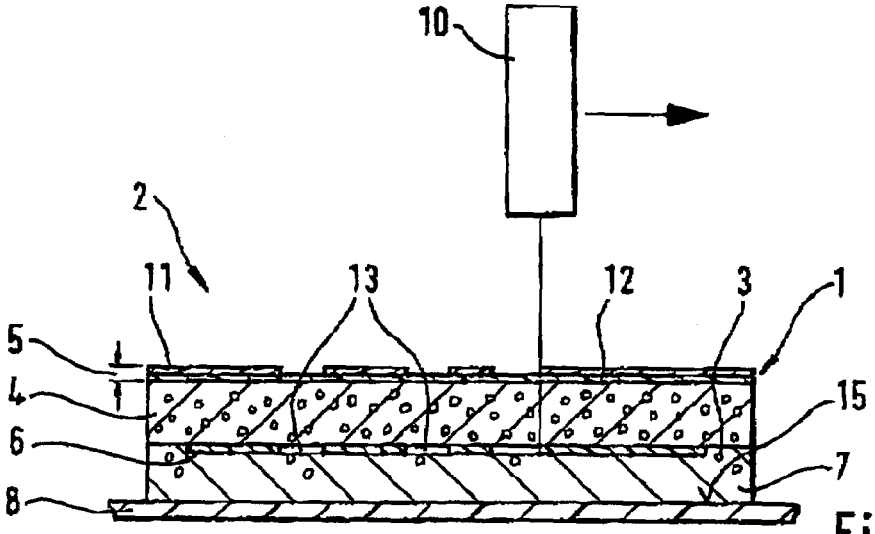
Figure 1C:
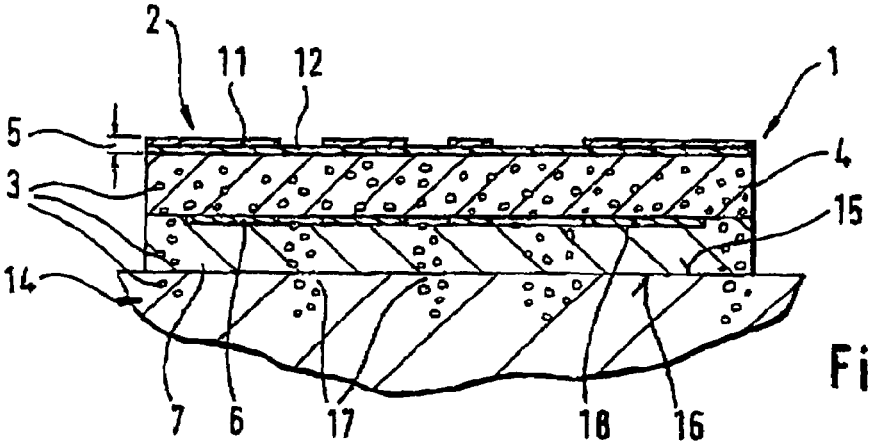
Figure 2:
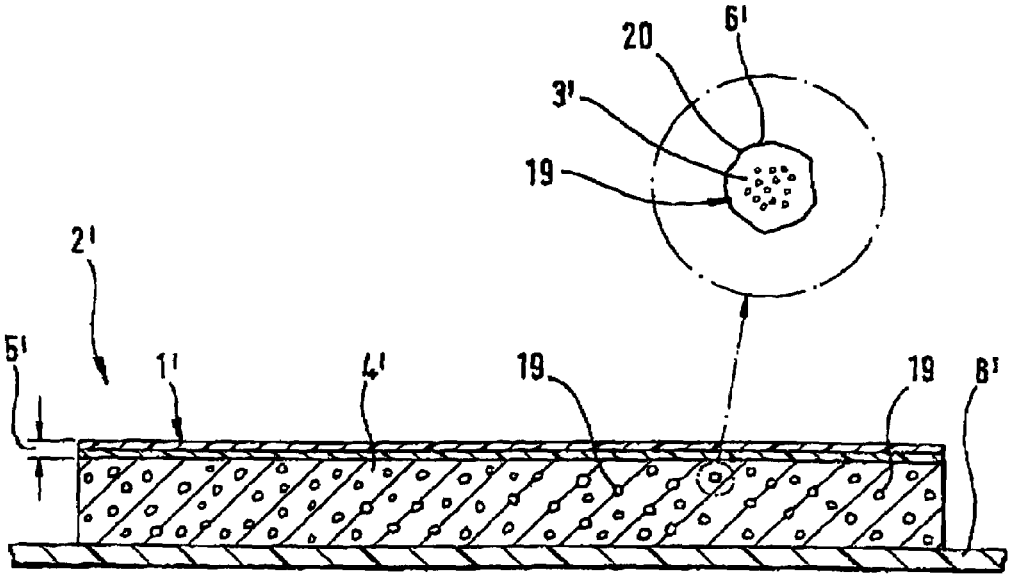
Figure 3:
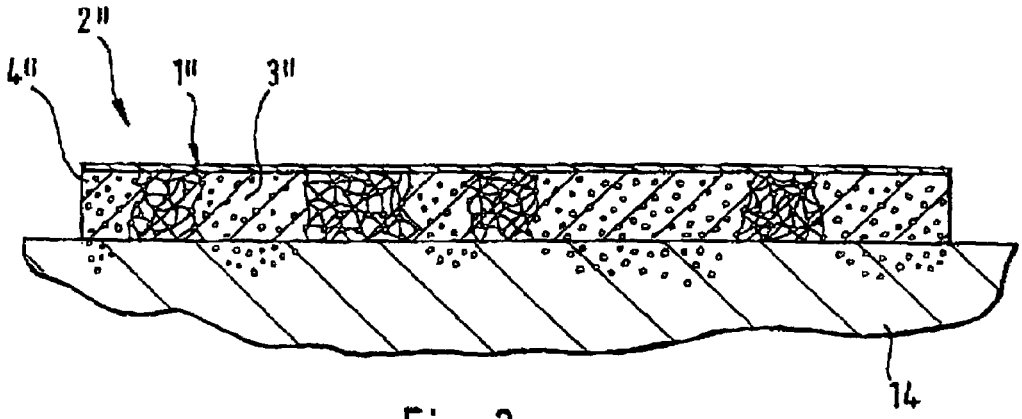

FIG. 1*a* . . . prior to the inscription,

FIG. 1*b* . . . during the inscription,

FIG. 1*c* . . . after adhesive bonding to a substrate,

FIG. 2 shows a sectional view of a security film with micro-encapsulated identification medium, FIG. 3 shows a sectional view of a security film with an identification medium which can be fixed by the inscription.

FIGS. 1*a* to 1*c* show a security label 2 which has been produced from the security film 1 according to the invention and contains a carrier layer 4, which contains an identification medium 3 which can diffuse in the carrier layer 4. The carrier layer 4 is applied to a covering layer 5, which ensures the mechanical stability of the label 2. On the opposite surface of the carrier layer 4 from the covering layer 5 there is a barrier layer 6, which in turn adjoins an adhesive layer 7. The adhesive layer 7 of the label 2 is provided with a release paper 8, which facilitates handling of the labels during transport, separation and inscription and prevents undesirable adhesion of the adhesive layer 7 during the processing steps.

FIG. 1*a* shows an uninscribed label 2. In this state, the barrier layer 6 is a continuous layer which is impervious to the identification medium 3. It covers a barrier area 9 which is at least as large as the inscription area 9' which is provided for the inscription of the label 2. The barrier layer 6 expediently extends over the entire surface of the label 2 and therefore ensures that prior to inscription there cannot be any diffusion of the identification medium 3 from the carrier layer 4 into the adhesive layer 7 at any point on the label 2.

In the present exemplary embodiment, the carrier layer 4 consists of a resin-modified acrylate adhesive compound. It contains, as identification medium 3, a substance which can migrate and serves as a carrier for UV-fluorescent dye. In the present exemplary embodiment, the carrier film has an added UV pigment of 1–3% (e.g. C-fluorescent pigment to prevent forgery of security papers, documents or products, such as for example $Y_2O_2S$:Eu) and additionally contains 3–6% of dibutylphthalate as carrier. The barrier layer 6, which prevents migration of carrier molecules and fluorescent pigments, is formed by a thin, transparent plastic film, e.g. a 12–25 $\mu$m-thick polyacetate film. The adhesive layer 7—like the carrier layer 4—consists of an adhesive compound based on a resin-modified acrylate polymer. The covering layer 5 consists of a multi-layer film, as described, for example, in utility model DE 81 30 861. This covering layer 5 can be inscribed with the aid of a laser 10, the upper layer 11 of paint being removed, so that the layer of paint 12 below appears locally.

The inscription of the label 2 (cf. FIG. 1*b*) is the process in which diffusion of the identification medium 3 from the carrier layer 4 into the adhesive layer 7 is made locally possible in a controlled manner. This takes place by controlled local weakening of the barrier layer 6. In the present exemplary embodiment, for this purpose the laser radiation penetrates through both the covering layer 5 and the carrier layer 4 and therefore, after penetrating through these two layers, must remain sufficiently powerful to locally break through or weaken the barrier layer 6. If a barrier layer 6 of polyacetate film is used, this film is locally destroyed by the standard cutting process used to inscribe the covering film, with the aid of a laser 10, and at these holes 13 allows the identification medium-3 to migrate into the adhesive layer 7. To ensure that the local destruction of the barrier layer 6 is a reliable process during the inscription, the laser power which is used for inscription has to be selected at a suitable high level. Furthermore, the barrier layer 6 must have a sufficiently high absorption capacity for the radiation.

As an alternative or in addition to the inscription of the barrier layer 6 described above, which takes place through the covering layer 5 and carrier layer 4, the barrier layer 6 may also be inscribed from the adhesive layer 7. In this case, release paper 8 and adhesive layer 7 must be sufficiently transparent to the laser radiation.

The inscription may comprise, for example, letters, numbers or an alpha-numeric sequence. The inscription may also include a barcode, a graphic symbol, a company logo and/or a mixture of a plurality of these symbols.

After the laser inscription has taken place, the security label 2 can then be adhesively bonded to a substrate 14 (cf. FIG. 1*c*). For this purpose, it is removed from the release paper 8 and the underside 15 of the adhesive layer 7 which is then exposed is pressed onto the substrate 14. The identification medium 3 which is diffused through the holes 13 in the barrier layer 6 and through the adhesive layer 7 then comes into contact with the substrate surface 16. The (UV) fluorescent pigment contained in the identification medium 3 then produces local (UV) dyeing of the substrate surface 16 therefore an image 17 of the inscription pattern which can be detected, for example, with the aid of a UV lamp.

To ensure that the identification medium leaves behind detectable traces on the substrate surface 16, the properties of the identification medium 3 have to be matched to those of the substrate 14. If a visible dye, the color of which contrast with the color of the substrate surface 16, is selected as identification medium 3, the inscription can be deciphered by the naked eye. If the identification medium 3 has, for example, an etching effect on the substrate, the inscription leads to a local change in the reflection properties of the substrate surface 16, which can be detected, for example, by optical methods, (in particular with grazing incidence). Furthermore, it is possible to select an identification medium 3 which does leave behind any visible traces on the substrate 14 but whose presence on the substrate surface 16 can be detected chemically by wetting the substrate surface 16 with a suitably selected substance, which undergoes a chemical reaction with the identification medium which can be detected by physical means (e.g. by changing the pH, which is represented by a change in color of the wetting substance). Furthermore, the identification medium 3 may contain a magnetic marker substance. The local magnetization of the substrate 14 produced by the inscription can then be deciphered by applying a magnetically active detection substance.

The security label 2 which is produced from the security film 1 according to the invention is suitable in particular for marking bodies in the automotive industry. The use of the security label 2 on, for example, the shell, frame and/or chassis allows unambiguous identification of the vehicle. For this purpose, the identification medium 3 is expediently selected in such a way that it leaves behind detectable traces on the vehicle paint. Furthermore, it is also possible to mark vehicle components and devices. This is recommended in particular for components which are particularly at risk of theft (car radios, car telephones) or particularly susceptible to forgery (expensive items of equipment, expensive safety components).

The properties of the identification medium 3 and of the adhesive layer 7 determine how quickly the diffusion of the identification medium 3 through the adhesive layer 7 onto the substrate 14 takes place and therefore determine a relaxation time after which detectable marking of the substrate 14 has taken place. This relaxation time is highly temperature-dependent. For the reaction of the above-described film on automotive paint, this relaxation time is approximately 2 hours at room temperature. If the label 2 remains on the substrate 14 for a significantly shorter period than the relaxation time, it can be removed without detectable marking of the substrate surface 16 having occurred. Therefore, within the relaxation time it is possible to replace a label which has been stuck on incorrectly with a correct label.

The greater the permeability of the adhesive layer 7 to the diffusing identification medium 3, the more intensive the lateral diffusion of the identification medium 3 in the adhesive layer 7 itself. This leads to the identification medium 3 reaching the substrate surface 16 even —although to a lesser extent—in areas which lie opposite the unbroken areas 18 of the barrier layer 6 and should therefore remain unaffected by the identification medium 3. This effect leads to a certain blurring of the contour of the inscription pattern 17 on the substrate 14. To achieve a high-contrast inscription of the substrate 14, it is recommended for the adhesive layer 7 to be selected to be as thin as possible, in order to keep this lateral diffusion of the identification medium 3 as low as possible. The thinner the adhesive layer 7, the shorter the diffusion time of the identification medium 3 through the adhesive layer 7.

As an alternative, the laser inscription of the security label 2 may also take place only once the (uninscribed) label 2 has been adhesively bonded to the substrate 14. In this case, the laser power which is set for the inscription must on the one hand be selected to be sufficiently high to ensure that the local destruction of the barrier layer 6 takes place reliably, but on the other hand the laser inscription should not cause any damage to the substrate. Inscription of the label 2 which has already been stuck down therefore requires good control of the laser power and can only be employed for selected substrates 14.

Naturally, the above-described inscription of the covering layer 5 may also take place in a separate process step, independently of the local destruction of the barrier layer 6, if the two inscription processes are initiated by radiation in different electromagnetic spectral regions. In particular, it is also possible to eliminate inscription of the covering layer 5 altogether.

An alternative form of the security film 1' according to the invention and of a security label 2' produced therefrom is illustrated in FIG. 2. It comprises a covering layer 5', to which a carrier layer 4', which contains an identification medium 3' and consists of an adhesive compound, is applied. The carrier layer 4' is protected by a release paper 8'. In this exemplary embodiment, the identification medium 3' in the carrier layer 4' is in micro-encapsulated form. Each capsule 19 contains a microscopic quantity of the identification medium 3' and is surrounded by a capsule wall 20. Therefore, in this exemplary embodiment the capsule wall 20 forms a barrier layer 6' which inhibits the free diffusion of the identification medium 3'. In the present example, the capsule wall 20 consists of a substance which can be broken open by the effects of temperature (e.g. wax or fat). If the security label 2' is locally irradiated with the aid of a focused laser 10 of sufficient power, the identification medium 3' is liberated in the irradiated areas and begins to migrate. After the security label 2' has been adhesively bonded to a substrate 14, the liberated identification medium can therefore penetrate locally into the substrate surface 16, where it leaves behind a marking which corresponds to the inscription.

In this exemplary embodiment, the identification medium 3' can diffuse not only towards the substrate 14 but also laterally into other (uninscribed) areas of the carrier layer 4'. This may lead to blurring of the contours of the inscription. To minimize this effect, the label 2' should be adhesively bonded to the substrate 14 immediately after the inscription; furthermore, the label 2' should be removed after a certain "action time". To prevent the lateral diffusion of the identification medium 3', it is also possible for the carrier layer 4' to be a material which greatly suppresses, in a selective manner, the diffusion of the identification medium 3' into the uninscribed areas.

In the exemplary embodiments which have been described hitherto, the local inscription involves local liberation of the identification medium 3 or 3'. Alternatively, in the security film 1", a local change in the diffusion of the identification medium 3" from the security label 2" to the substrate 14 can also be achieved by local fixing of the identification medium 3" (cf. FIG. 3). The local action of light and/or heat greatly reduces the diffusability of the identification medium 3", which in the uninscribed state diffuses freely through the carrier layer 4" (e.g. by precipitation, crosslinking, etc.). Suitable processes for this purpose are known, for example, from the photographic industry. If the label 2" is then adhesively bonded to a substrate 14, the identification medium 3" diffuses onto the substrate 14 only in those areas in which the identification medium 3" can still move freely. Many of the processes used to fix the identification medium 3" are based on photochemical processes. They are typically highly temperature-dependent and react sensitively to light. In order nevertheless to ensure the robustness of the label 2" and of the inscription image, it is recommended for the label 2" only to be left on the substrate 14 until the identification medium 3" has locally reacted with the substrate 14; the label 2" should then be removed, in order to prevent changes in the inscription caused by the influences of temperature and light, which could lead to undesired liberation/fixing of the identification medium 3" in the label, and therefore to aging of the inscription on the substrate 14. Naturally, however, the label 2" can also remain on the substrate 14 if a less sensitive process is selected for fixing the identification medium 3" or if the influences of temperature and/or light which have been described above can be prevented by the particular use of the label 2".

In addition to the security labels 2, 2', 2" which have been described hitherto and are produced from the security film 1, 1', 1" according to the invention, the security film 1, 1', 1" may also be used, for example, in the form of adhesive tape, covering film, decorative film and protective film, etc.

What is claimed is:

1. A security film that can be adhesively bonded to a substrate, comprising:

a carrier layer that contains an identification medium which causes a detectable reaction in the substrate; and a barrier layer arranged between the carrier layer and the substrate and which, in an uninscribed state, prevents diffusion of the identification medium from the security film to the substrate;

wherein the barrier layer is comprised of a material which is weakenable after the barrier layer has been arranged on the carrier layer, such that local variation in the diffusion of the identification medium from the security film to the substrate is produced by local weakening of the barrier layer.

2. A security film according to claim 1, wherein the local weakening of the barrier layer is achieved by the local action of electromagnetic radiation.

3. A security film according to claim 1, wherein the local weakening of the barrier layer is achieved by the local action of heat.

4. A security film according to claim 1, wherein local weakening of the barrier layer is achieved by local action of a laser beam.

5. A security film according to claim 1, wherein the identification medium comprises at least one selected from the group consisting of a UV-fluorescent marker substance, an infrared marker substance, a magnetic marker substance, and a dye.

6. A security film according to claim 1, wherein the identification medium comprises a substance that causes a chemical reaction in the substrate.

7. A security film according to claim 1, wherein the identification medium comprises a substance that partially etches a surface of the substrate.

8. A security film according to claim 1, wherein the carrier layer comprises the identification medium.

9. A security film according to claim 1, wherein the security film further comprises a laser-inscribable covering layer.

10. A security film according to claim 1, wherein the security film is arranged on a release paper.

11. A method of marking a motor vehicle, comprising applying a security film according to claim 1 to a part of the motor vehicle.

12. A motor vehicle comprising a security film according to claim 1.

13. A part of a motor vehicle comprising a security film according to claim 1.

14. A security film according to claim 1, wherein the substrate is a vehicle paint.

15. A method for inscribing a security film that can be adhesively bonded to a substrate, said method comprising:

adhesively bonding a security film to the substrate, wherein the security film comprises a carrier layer containing an identification medium and a barrier layer arranged between the carrier layer and the substrate and which, in an uninscribed state, prevents diffusion of the identification medium from the security film to the substrate; and inscribing the security film by a contactless process, thereby locally weakening the barrier layer and allowing selective diffusion of the identification medium from the security film to the substrate.

16. A method according to claim 15, wherein the contactless process comprises applying electromagnetic radiation.

17. A method according to claim 15, wherein security film according to claim 14, wherein the contactless process comprises locally applying heat.

18. A method according to claim 15, wherein the contactless process comprises locally applying a laser beam.

19. A method according to claim 15, wherein the identification medium comprises at least one selected from the group consisting of a UV-fluorescent marker substance, an infrared marker substance, a magnetic marker substance, and a dye.

20. A method according to claim 15, wherein the identification medium comprises a substance that causes a chemical reaction in the substrate.

21. A method according to claim 15, wherein the identification medium comprises a substance that partially etches a surface of the substrate.

22. A method for inscribing a security film that can be adhesively bonded to a substrate, said method comprising:

inscribing a security film comprising a carrier layer containing an identification medium and a barrier layer arranged between the carrier layer and the substrate by a contactless process, thereby locally weakening the barrier layer and changing diffusion properties of the identification medium in the security film; and adhesively bonding the security film to a substrate.

* * * * *